United States Patent [19]

Prenn

[11] 4,168,392

[45] Sep. 18, 1979

[54] COMPOSITE ELECTRODE WITH NON-CONSUMABLE UPPER SECTION

[75] Inventor: Otto E. Prenn, Sherwood Park, Canada

[73] Assignee: The Steel Company of Canada, Limited, Hamilton, Canada

[21] Appl. No.: 904,198

[22] Filed: May 9, 1978

Related U.S. Application Data

[63] Continuation-in-part of Ser. No. 730,621, Oct. 7, 1976.

[30] Foreign Application Priority Data

Sep. 1, 1976 [CA] Canada ..... 260316

[51] Int. Cl.[2] ..... H05B 7/14; H05B 7/07

[52] U.S. Cl. ..... 13/18 R

[58] Field of Search ..... 13/9, 18 R, 18 A, 18 B, 13/18 C, 14–17

[56] References Cited

U.S. PATENT DOCUMENTS

| | | | |
|---|---|---|---|
| 824,153 | 6/1906 | Seward | 13/18 S |
| 3,193,889 | 7/1965 | Lane et al. | 13/9 X |
| 3,489,841 | 1/1970 | Cheng | 13/9 |

*Primary Examiner*—R. N. Envall, Jr.
*Attorney, Agent, or Firm*—Sim & McBurney

[57] ABSTRACT

This invention provides a composite electrode having a metallic, water cooled upper portion and a consumable lower portion. The portions are secured together, and the upper one includes conduit means within it to permit cooling water or other liquid to move along a path which brings the cooling liquid into intimate contact with substantially all of the inside surface of the outer wall defining the periphery of the upper portion.

4 Claims, 4 Drawing Figures

COMPOSITE ELECTRODE WITH NON-CONSUMABLE UPPER SECTION

This application is a continuation-in-part of United States patent application Ser. No. 730,621, filed on Oct. 7, 1976.

This invention relates generally to electrodes utilized in electric-arc furnaces, and has to do particularly with the construction of a composite electrode intended to provide advantages over the electrodes currently in use.

Electrode consumption contributes substantially to the total cost of electric furnace steelmaking. Electrode consumptions can be broken down into tip losses, side oxidation losses and column breakage losses.

Conventional practice typically utilizes an electrode configuration consisting of multiple sections of graphite cylinders threaded together with graphite nipples. An electrode clamp holds this column in position and transfers the electrical power to the graphite cylinders. The diameter of conventional cylinders must be uniform and the surface must be machined smooth in order to promote the best electrical transfer without "hot spots" or arcing. During use, the electrode column is "slipped" as tip erosion takes place, and new sections are added at the top. The high temperature and oxidizing atmosphere in the furnace consumes the exposed area of the electrode and promotes a taper towards the tip. The graphite oxidation losses of this kind typically amount to from 50% to 70% of the total consumed.

The taper also reduces the wall thickness at the joints, thus rendering the column more prone to breakage. The most serious breakage occurs when scrap movement within the furnace cause the upper joint to fail, with the resultant loss of an entire column. The taper also makes it difficult to seal the region between the electrode and the roof of the furnace to prevent fumes from escaping.

Various attempts to combat these problems have been made in the past. In an attempt to reduce the rate of electrode oxidation, coating or cladding has been applied to the surface utilizing temperature-resistant materials. Because of problems with electrical transfer in the clamp area, most such materials have been applied only below the clamp. Marginal success has been obtained with such materials because of the difficulty of wetting and sticking to the graphite. The application of a conductive coating applied over the entire electrode under vacuum or by plasma arc spraying have proven uneconomical.

In view of the foregoing difficulties with conventional practice, it is an aspect of this invention to provide a composite electrode construction capable of reducing side oxidation of the graphite portion and of reducing column breakage losses. Additional advantages of light weight and greater utilization of the graphite of the electrode are also aspects of this invention. A further aspect is to make less critical the dimensions and surface characteristics of the graphite portion of the electrode.

Accordingly, this invention provides a composite electrode for electric arc furnaces, comprising:

an elongated metallic portion having a top end and a bottom end, the portion including an outer wall of substantially uniform section along its length, the outer wall having an outside surface and an inside surface, an inner wall spaced inwardly from the outer wall to define a passage of annular section, conduit means longitudinally within said metallic portion and communicating with the bottom of said passage to allow cooling liquid to move within said portion along a path which brings cooling liquid into intimate contact with substantially all of the inside surface of said outer wall, an elongated consumable portion having a top end and a bottom end, and connector means for joining the top end of the consumable portion to the bottom end of the metallic portion, the said connector means including a metallic double-male threaded nipple, and a female recess in the bottom end of said elongated metallic portion, said female recess opening through to the interior of the metallic portion, the threaded nipple being hollow with one end open and the other end closed, and being threaded into said female recess with the open end upward so that the interior of the nipple communicates with the interior of the metallic portion; and in which said conduit means is a central pipe extending axially down the metallic portion and into the interior of the threaded nipple.

Two embodiments of this invention are illustrated in the accompanying drawings, in which like numerals denote like parts throughout the several views, and in which.

Figure 1:
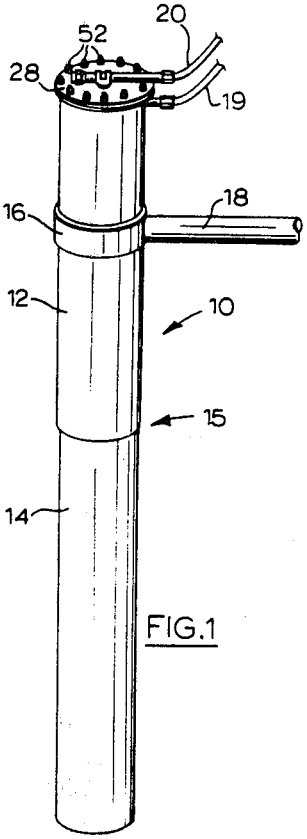
FIG. 1 is a perspective view of the composite electrode of this invention.

In FIG. 1, the composite electrode 10 is seen to include an upper metallic portion 12 and a lower consumable portion 14. Means are provided at the joint 15 for securely connecting the two portions together, these means to be described subsequently. A typical electrode clamp 16 is provided, having a support arm 18 extending from control apparatus (not shown) of the conventional type which is adapted to pass electrical current along the arm 18 through the clamp 16 and to the composite electrode, and which also is capable of adjusting the vertical height of the composite electrode to bring about the most desirable arc characteristics in accordance with conventional practice.

At the top of the portion 12, two cooling water lines 19 and 20 are provided to carry cooling water to and from the upper portion 12.

It is to be understood that the composite electrode 10 shown in FIG. 1 would be inserted downwardly through the conventional opening in the roof of a standard electric arc furnace, with conventional means for substantially sealing the remainder of the roof opening against the escape of gases. These parts are conventional, and have not been illustrated.

Figure 2:
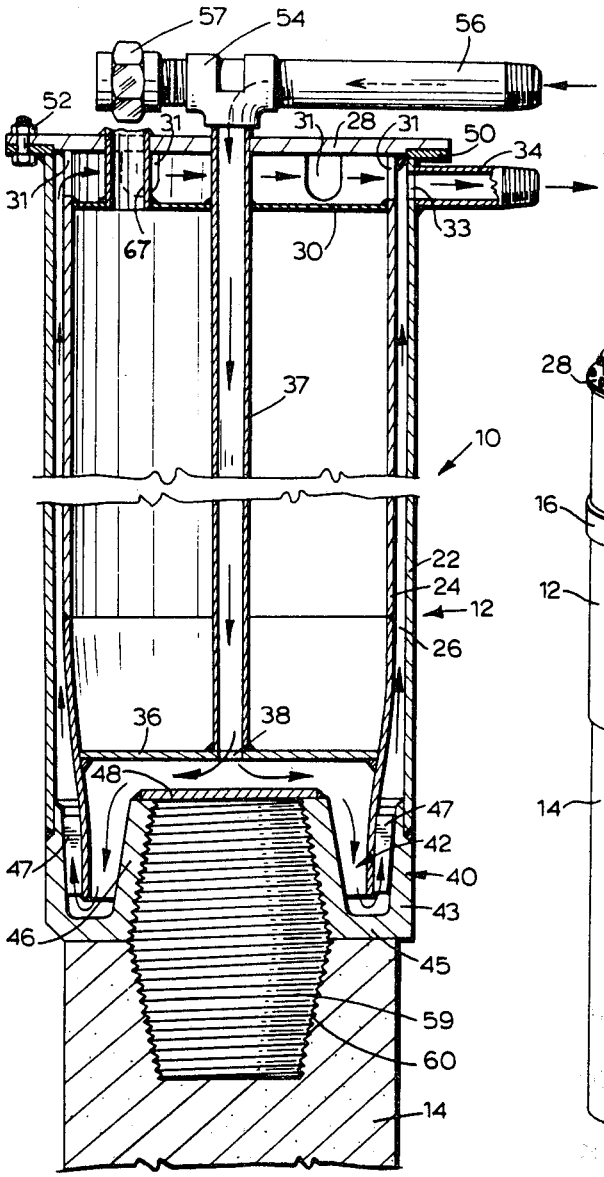
FIG. 2 is a longitudinal sectional view of one embodiment thereof.

Turning now to FIG. 2, the construction of the upper or metallic portion 12 of the composite electrode 10, which may be of ferrous material, is seen to include an outer wall 22 of cylindrical configuration and an inner wall 24 which is also cylindrical but which is spaced inwardly and concentrically with respect to the outer wall 22 to define a passage 26 of annular section between the two walls. The passage 26 is intended to be the upward leg of a cooling-water circulation path within the metallic section 12 of the composite electrode Spanning across the top of the both walls 22 and 24 is a circular top wall 28 which is dimensioned to extend beyond the outside surface of the outer wall 22, as can be seen in both figures.

A first intermediate transverse partition 30 is provided in spaced relationship below the upper wall 28 extending only within the inner wall 24 and welded thereto. Above the partition 30, the inner wall 24 is provided with a plurality of openings 31 for the purpose of allowing the cooling water passing upwardly along the annular passage 26 to move readily and with low resistance to an opening 33 communicating with an outlet pipe 34 extending radially outwardly from the upper end of the outside wall 22.

A further intermediate partition 36 is provided toward the lower end of the portion 12, again spanning only within the confines of the inner wall 24 and welded thereto.

A central, axial pipe 37 passes downwardly through the upper wall 28 and the partition 30, and terminates at a central opening 38 in the partition 36, whereby water may pass down the pipe 37 to the area below the partition 36.

At the lower end of the outside wall 22 there is provided a member 40 which is radially symmetrical and which defines an annular, upwardly open channel 42 between an outer cylindrical wall 43, a lower annular wall 45, and an inner, frusto-conical wall 46. Across the upper open end of the inner, frusto-conical wall 46 is a circular plate 48. The chamber defined by the annular channel 42, the plate 48 and the partition 36 constitutes, in effect, a generally circular passage (with a downward peripheral portion) for carrying cooling liquid from the bottom of the pipe 37 radially outwardly to the bottom of the passage 26 of annular section. As can be seen especially in FIG. 2, the inner wall 24 extends downwardly within the annular channel 42, and thus requires the cooling water to move continuously along the inner surface of the member 40, ensuring that it will be cooled uniformly. If the inner wall 24 did not extend down into the channel 42, there is a risk that the water at the lower end of the channel 42 would remain static, become overheated, and flash to steam, thus resulting in an explosion.

Located in the lower end of the annular passage 26 are a plurality of longitudinally oriented vanes 47 for the purpose of minimizing turbulence in the passage 26 and for promoting laminar flow of cooling liquid therealong.

The upper end of the outer wall 22 is welded to an annular flange 50 which has the same outer diameter as the top wall 28. The flange 50 and the top wall 28 are adapted to be bolted together as by bolts 52 with a gasket between them, in order to seal the upper end of the annular passage 26. It will be appreciated that there is no permanent, bracing contact between the inner wall 26 (including the partitions 30, 36 and the central pipe 37) and the outer wall 22 (including the lower member 43). It is desirable to be able to remove the entire inner portion from the outer portion for maintenance, inspection, etc. It is for this reason that the flange 50 has been provided, so that the only location of attachment between the two parts is at the top, by way of the bolts 52.

A T-coupling 54 is threaded to the upper end of the pipe 37, and a water inlet pipe 56 is connected thereto. Threaded into the other opening of the T-coupling 54 is a safety head 57 of conventional construction.

At the lower end of the portion 12, the inner surface of the frusto-conical wall 46 is formed to define threads which are adapted to receive the mating threads of a graphite nipple 59 which is of the usual type utilized in conventional practice to connect two graphite cylinders together. The consumable, graphite electrode 14 also has a threaded, female recess 60 in its upper end, to receive the other end of the double-male threaded nipple 59.

It can be seen especially in FIG. 2 that the diameter of the consumable graphite portion 14 of the composite electrode has a smaller diameter than the upper portion. In conventional practice, the electrodes tend to be somewhat oversized for the sake of mechanical strength, i.e. the diameter of the electrodes has been somewhat greater than the electrical requirement would call for. With the present construction, however, the diameter of the graphite portion of the composite electrode may be reduced to the minimum necessary for considerations other than mechanical strength, because the inherent cooling of the upper end of the graphite portion 14 due to contact the water cooled metallic portion 12 will reduce the extent to which the graphite material oxidizes away at the surface, and will allow the initial strength of the connection between the two portions to be maintained. Also, as pointed out previously, the surface characteristics of the graphite portion 14 of the composite electrode do not need to meet the high standards previously called for due to the necessity of making good electrical connection therewith.

In the case of the present composite electrode, the clamp 16 is mounted directly to the upper metallic portion 12, and this will be a metal-to-metal contact with excellent electrical conduction characteristics.

It will be appreciated that, by keeping the greater part of the interior volume of the upper portion 12 free of water, the weight of the entire section can be reduced to a minimum. In fact, the construction illustrated in FIG. 2 is one which can reduce the total weight of the upper section to less than that of a conventional graphite electrode with the same diameter. This will lower the weight that the electrode mast (associated with the arm 18) must lift, and thus will decrease maintenance costs while increasing the lifting speed.

The joint location where the consumable and the non-consumable portions of the composite electrode are attached together can be placed lower on the electrode as a whole than the lowermost joint normally occurs on conventional electrodes. Thus, accidental scrap caves or furnace movements which exert a force on the side of the electrode will generate less torque in the joint area (due to the shorter moment arm), thus reducing the possibility of breakage. Also, any joint breakage which does occur will lose less electrode weight because the joint is lower.

It is considered important to construct a female joint on the water cooled section, so that any expansion which occurs due to heating of the bottom portion and the graphite connecting pin will tighten the joint rather than loosen it.

By providing a single metallic upper portion 12 for the electrode, various diameter electrodes can be accommodated for the bottom section. In the past, the electrode diameter has been fixed to a single size because of the high cost of changing electrode clamps.

If desired, the lower electrode section can be coated with an oxidation resistant coating. The coating can be applied over the entire surface since the electrodes will not be gripped by clamps for electrical transfer. The material could even be applied during manufacture of the graphite portion of the electrodes. Alternatively, a cladding material could be used to slow oxidation losses. On an ordinary electrode, the dissimilar properties of the graphite and the cladding material tend to cause non-uniform expansion and slippage of the cladding. Also, rivet or screw fastening of the cladding to the electrode tends to be difficult because of the brittle nature of graphite. In the present invention, however, cladding material could be suspended from the non-consumable top section with some form of support system. This could be designed to easily accommodate the replacement of electrode sections.

The remainder of the volume within the upper metallic portion 12 of the composite electrode is entirely sealed from communication with the liquid-flow path described earlier, and is intended to contain only air. In order to avoid variation of air pressure within this remaining volume due to heating, a communication pipe 67 is provided, opening through the partition 30 at the bottom, and through the upper wall 38 at the top.

Figure 3:
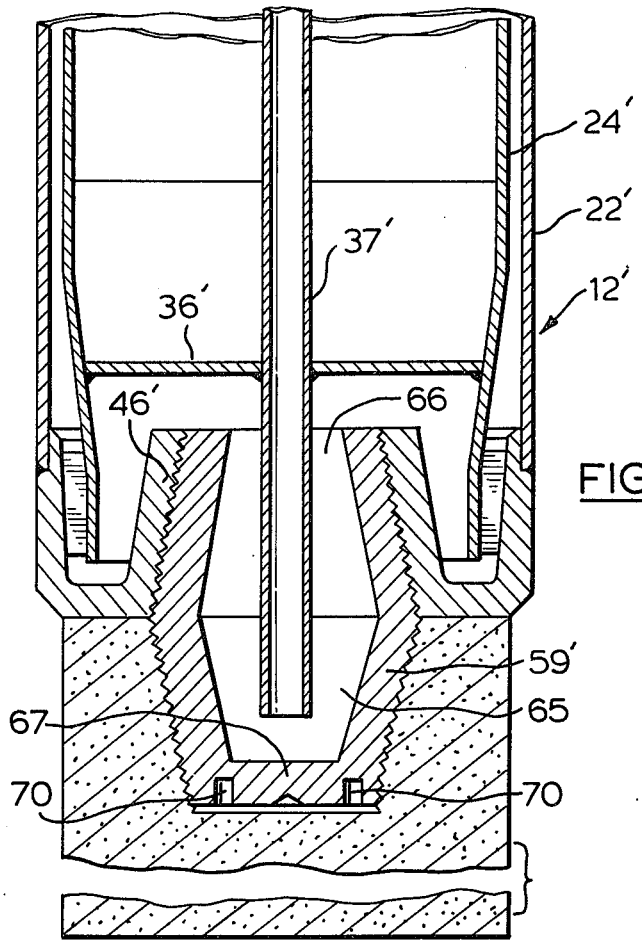
FIG. 3 is a longitudinal sectional view of a second embodiment thereof.
Figure 4:
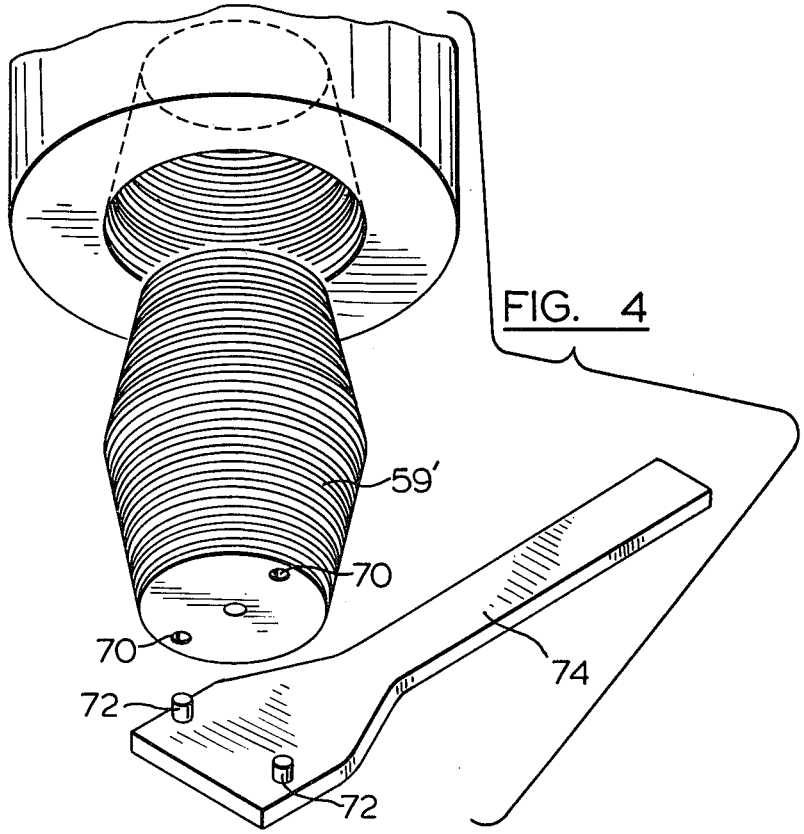
FIG. 4 is a perspective view of several components of the second embodiment, in exploded relation.

Turning now to FIGS. 3 and 4, which illustrate the second embodiment of this invention, the upper metallic portion 12' is substantially identical to the upper metallic portion 12 shown in FIG. 2, with the exception that the circular plate 48 is not present. Instead, the upwardly converging threaded female recess defined by the frusto-conical wall 46' opens directly through to the interior of the portion 12. Of course, the intermediate partition 36' blocks the access in terms of the air-filled part of the portion 12.

The main difference between the second embodiment shown in FIG. 3 and the first embodiment shown in FIG. 2 relates to the internal construction of the double-male nipple 59'. In the case of the second embodiment shown in FIG. 3, the double-male nipple 59' is not of graphite but is machined from a metal such as copper or steel.

The double-male threaded nipple 59' is hollow with a central cavity 65 having the upper end 66 open and the lower end 67 closed.

The central, axial pipe 37' in the second embodiment extends further downwardly than does the pipe 37 in the first embodiment. As can be seen in FIG. 3, the pipe 37' extends axially down into the interior cavity 65 of the nipple 59'. Thus, when cooling liquid is forced downwardly along the central pipe 37', its path includes a portion which extends from the bottom of the central pipe 37' upwardly out of the interior of the threaded nipple 59', thence radially outwardly and downwardly to the lower end of the passage of annular section defined between the outer wall 22' and the inner wall 24'.

The threaded nipple 59' has two diametrically opposed recesses 70 in its lower end, which are adapted to receive protuberances 72 on a manual tool 74 which is adapted to permit tightening of the double-male nipple 59' into the upwardly converging female recess defined by the frusto-conical wall 46' of the portion 12'.

In actual trials on several 25 ton electric furnaces, it was found that electrode consumption was reduced by roughly 15% for the composite electrode, compared to the conventional construction utilizing all graphite portions. It was also observed that cooling in the joint area between the consumable and non-consumable portions prevented tapering of the graphite lower portion for almost 2 feet more than on the conventional consumable string of graphite cylinders.

It was further observed that the joint between the consumable and non-consumable sections remained cool, and was easy to unscrew for the purpose of replacing one graphite section with another.

To summarize the advantages provided by this invention, there is firstly a reduction of electrode consumption because no oxidation of the non-consumable top section takes place.

There is a further reduction of electrode consumption from breakage because of the cooling feature of the joint, which causes reduced taper and permits lower level of joints in the furnace.

Because the diameter of the upper portion of the electrode does not change, an improved furnace sealing possibility is provided, allowing greater fume control.

There is further a flexibility in the diameter, tolerance and surface characteristics of the electrodes utilized.

Finally, the complete electrode, including both portions, weighs less than the conventional electrode made of all graphite having the same diameter.

I claim:

1. A composite electrode for electric arc furnaces, comprising:

an elongated metallic portion having a top end and a bottom end, the portion including an outer wall of substantially uniform section along its length, the outer wall having an outside surface and an inside surface, an inner wall spaced inwardly from the outer wall to define a passage of annular section, conduit means longitudinally within said metallic portion and communicating with the bottom of said passage to allow cooling liquid to move within said portion along a path which brings cooling liquid into intimate contact with substantially all of the inside surface of said outer wall, an elongated consumable portion having a top end and a bottom end, and connector means for joining the top end of the consumable portion to the bottom end of the metallic portion, the said connector means including a metallic double-male threaded nipple, and a female recess in the bottom end of said elongated metallic portion, said female recess opening through to the interior of the metallic portion, the threaded nipple being hollow with one end open and the other end closed, and being threaded into said female recess with the open end upward so that the interior of the nipple communicates with the interior of the metallic portion; and in which said conduit means is a central pipe extending axially down the metallic portion and into the interior of the threaded nipple.

2. The invention claimed in claim 1, in which the path along which the cooling liquid moves includes a downward leg along said central pipe, an upward leg along said passage, and a portion from the bottom of the central pipe upwardly out of the interior of the threaded nipple, thence radially outwardly to the lower end of the passage of annular section.

3. The invention claimed in claim 2, in which there are longitudinal vanes at the bottom of said passage of annular section, for minimizing turbulence in said passage and for promoting laminar flow of cooling liquid.

4. The invention claimed in claim 1, claim 2 or claim 3, in which the said path occupies only a fraction of the internal volume of the metallic portion, the remainder of the volume being empty, being sealed from communication with the path, and being permanently in communication with the atmosphere through an opening in the top of the metallic portion.

* * * * *